US006201522B1

(12) United States Patent
Erhart et al.

(10) Patent No.: US 6,201,522 B1
(45) **Date of Patent: *Mar. 13, 2001**

(54) POWER-SAVING CIRCUIT AND METHOD FOR DRIVING LIQUID CRYSTAL DISPLAY

(75) Inventors: Richard Alexander Erhart, Chandler; Gerald T. Harder, Gilbert, both of AZ (US)

(73) Assignee: National Semiconductor Corporation, Santa Clara, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/218,255

(22) Filed: Dec. 21, 1998

Related U.S. Application Data

(60) Continuation of application No. 08/620,132, filed on Mar. 21, 1996, now Pat. No. 5,852,426, which is a division of application No. 08/291,134, filed on Aug. 16, 1994, now Pat. No. 5,528,256.

(51) Int. Cl.[7] ..... G09G 3/36

(52) U.S. Cl. ..... 345/96; 345/99; 345/209; 345/211

(58) Field of Search ..... 345/87, 94, 96, 345/99, 100, 208, 209, 211, 212

(56) References Cited

U.S. PATENT DOCUMENTS

| | | | |
|---|---|---|---|
| 4,100,579 | 7/1978 | Ernstoff | 358/230 |
| 4,710,768 | 12/1987 | Takeda et al. | 340/805 |
| 4,714,921 | 12/1987 | Kanno et al. | 340/784 |
| 4,781,437 | 11/1988 | Shields et al. | 350/332 |
| 4,864,182 | 9/1989 | Fujioka et al. | 315/169.3 |
| 4,955,696 | 9/1990 | Taniguchi et al. | 350/332 |

(List continued on next page.)

FOREIGN PATENT DOCUMENTS 0 631 271 A1 12/1994 (EP) .

OTHER PUBLICATIONS

"A Capacitively Coupled TFT–LCD Driving Method", by Etsuya Takeda, Yutaka Nan–no, Yoshiko Mino, Akio Otsuka, Shin–ichiro Ishihara, and Selichi Nagata, Proceedings of the SID , vol. 31/2, 1990, pp. 87–94.

An 8.4–in. TFT LCD System for a Note–Size Computer Using 3–Bit Digital Data Drivers, by H. Okada, M. Tanka, M. Okano, S. Ushira, H. Fukuoka, Y. Kanatani, M. Hijikigawa, *Japan Display*, 1992, pp. 475–478.

"An 15–in. Diagonal Full–Color High Resolution TFT–LCD", by H. Maeda, K. Fujii, N. Yamagishi, H. Fujita, S. Ishihara K. Adachi, E. Takeda, *SID 92 Digest*, p. 47–50.

*Primary Examiner*—Kent Chang
(74) *Attorney, Agent, or Firm*—Cahill, Sutton & Thomas P.L.C.

(57) ABSTRACT

A power-saving column driver integrated circuit, and a power-saving method for driving a liquid crystal display, include a series of multiplexers coupled to the columns of the display. The multiplexers selectively couple each of the columns to a common external storage capacitor during a portion of each row drive period for discharging each of the pixels in the selected row of the liquid crystal display to a median bias voltage. During the remaining portion of each row drive period, the multiplexers selectively couple voltage drivers to the columns of the LCD pixel array for applying a desired driving voltage to each column of the array. The polarity of the driving voltages applied to each column alternates on succeeding row drive periods, and the resulting voltage that is summed on the storage capacitor averages to the median bias voltage. For active matrix liquid crystal display panels, a multiplexer selectively couples the backplane of the display panel to either an external storage capacitor or to an alternating-polarity backplane driving voltage during each row drive period.

29 Claims, 3 Drawing Sheets

U.S. PATENT DOCUMENTS

| | | | |
|---|---|---|---|
| 4,958,105 | 9/1990 | Young et al. | 315/169.3 |
| 5,126,727 | 6/1992 | Asars | 340/760 |
| 5,130,703 | 7/1992 | Fairbanks et al. | 340/784 |
| 5,168,270 | 12/1992 | Masumori et al. | 340/784 |
| 5,170,155 | 12/1992 | Plus et al. | 340/784 |
| 5,170,158 | 12/1992 | Shinya | 340/800 |
| 5,192,945 | 3/1993 | Kusada | 340/784 |
| 5,198,747 | 3/1993 | Haight | 323/303 |
| 5,262,720 | 11/1993 | Senn et al. | 324/158 |
| 5,283,565 | 2/1994 | Suzuki et al. | 345/98 |
| 5,296,847 | 3/1994 | Takeda et al. | 345/92 |
| 5,313,222 | 5/1994 | Lee | 345/58 |
| 5,408,248 | 4/1995 | Crossland et al. | 345/96 |
| 5,581,273 | 12/1996 | Yoneda et al. . | |

FIG. 4
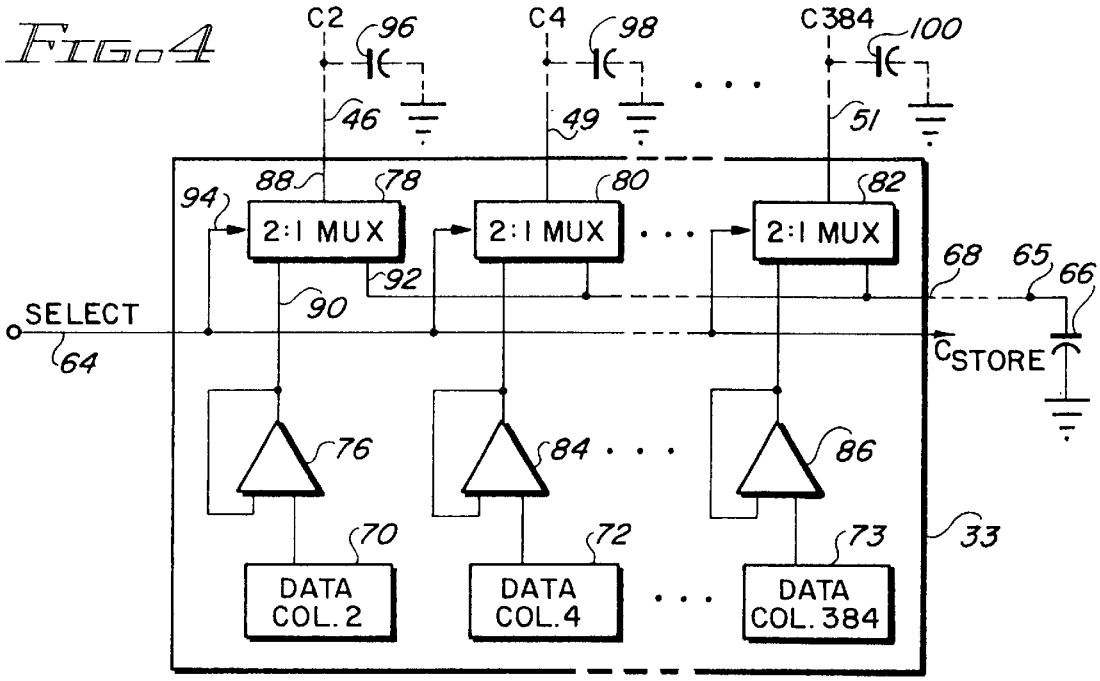
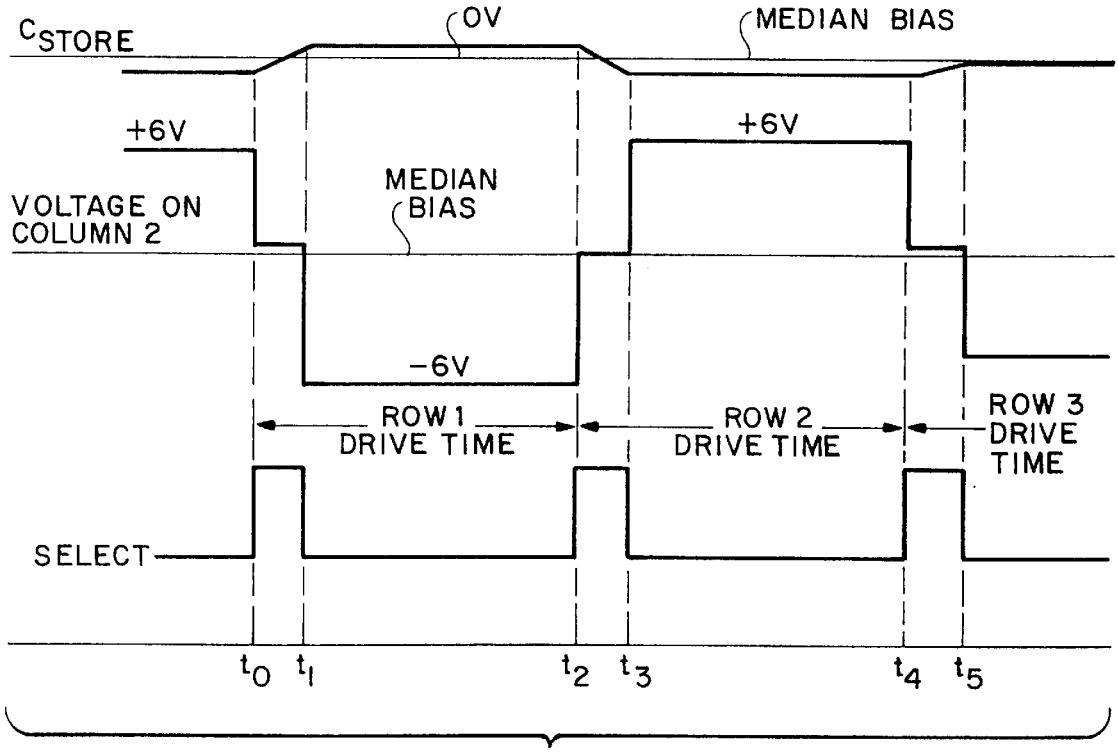
FIG. 5

FIG. 6
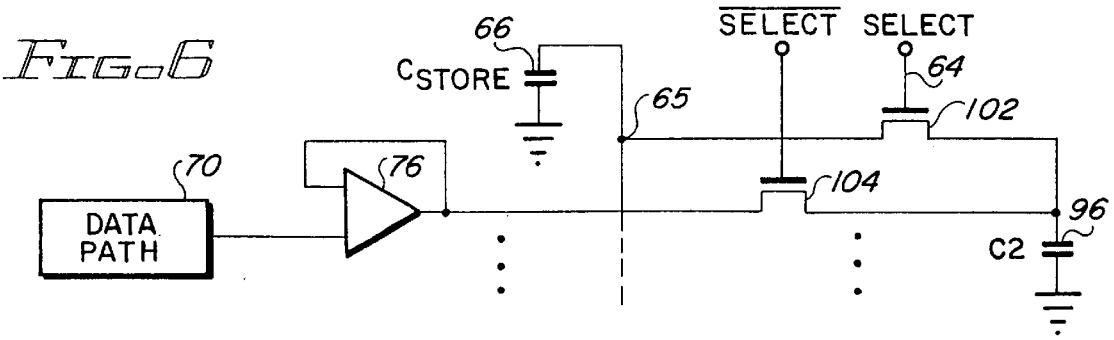
FIG. 7
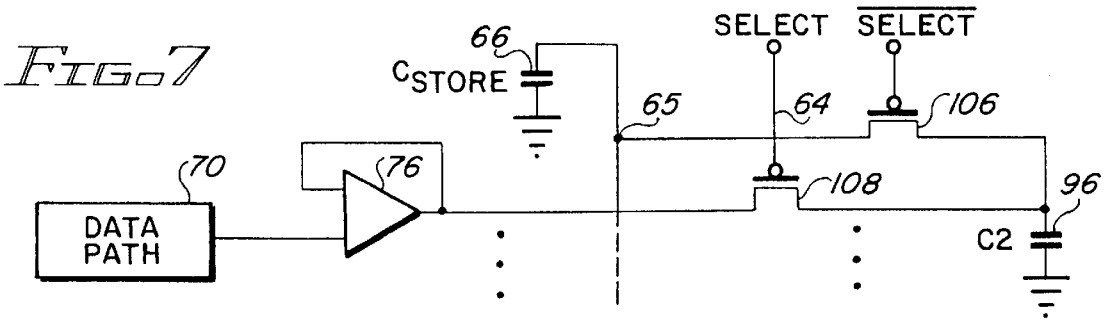
FIG. 8
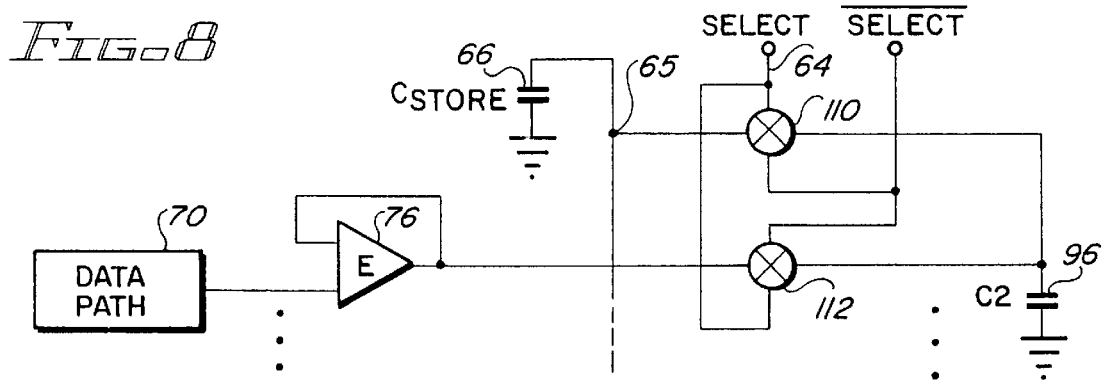
FIG. 9
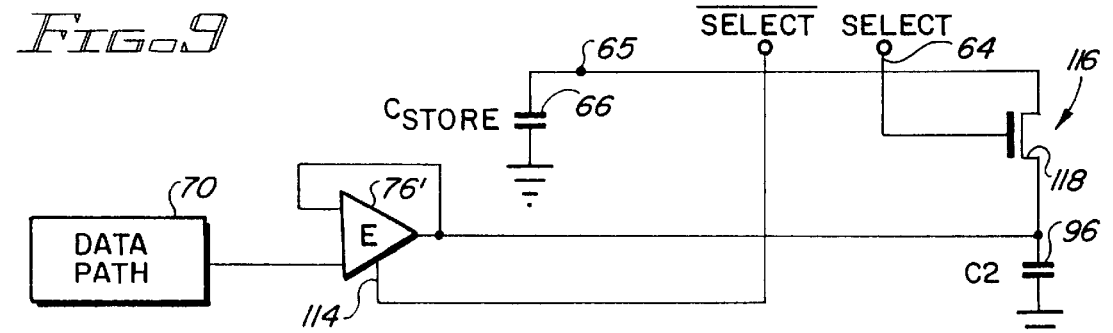
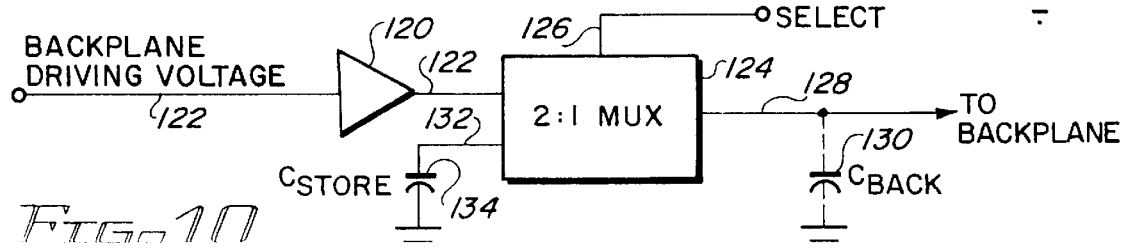
FIG. 10

POWER-SAVING CIRCUIT AND METHOD FOR DRIVING LIQUID CRYSTAL DISPLAY

CROSS-REFERENCE TO RELATED APPLICATIONS

This application is a continuation of U.S. patent application Ser. No. 08/620,132, filed Mar. 21, 1996, now U.S. Pat. No. 5,852,426, which application is a division of Ser. No. 08/291,134, filed Aug. 16, 1994, now U.S. Pat. No. 5,528, 256.

BACKGROUND OF THE INVENTION

1. Field of the Invention

The present invention relates generally to circuitry for driving an active or passive matrix liquid crystal display (LCD) or the like, and more particularly, to a circuit and method which reduce the amount of power required for driving columns of the LCD display matrix.

2. Description of the Background Art

LCD displays are used today in a variety of products, including hand-held games, hand-held computers, and laptop/notebook computers. These displays are available in both gray-scale (monochrome) and color forms, and are typically arranged as a matrix of intersecting rows and columns. The intersection of each row and column forms a pixel, or dot, the density and/or color of which can be varied in accordance with the voltage applied thereto in order to define the gray shades of the liquid crystal display. These various voltages produce the different shades of color on the display, and are normally referred to as "shades of gray" even when speaking of a color display.

It is known to control the image displayed on the screen by individually selecting one row of the display at a time, and applying control voltages to each column of the selected row. The period during which each such row is selected may be referred to as a "row drive period". This process is carried out for each individual row of the screen; for example, if there are 480 rows in the array, then there are typically 480 row drive periods in one display cycle. After the completion of one display cycle during which each row in the array has been selected, a new display cycle begins, and the process is repeated to refresh and/or update the displayed image. Each pixel of the display is periodically refreshed or updated many times each second, both to refresh the voltage stored at the pixel as well as to reflect any changes in the shade to be displayed by such pixel over time.

LCD displays used in computer screens require a relatively large number of such column driver outputs. Color displays typically require three times as many column drivers as conventional "monochrome" LCD displays; such color displays usually require three columns per pixel, one for each of the three primary colors to be displayed. Thus, a typical VGA (480 rows×640 columns) color liquid crystal display includes 640×3, or 1,920 column lines which must be driven by a like number of column driver outputs.

The column driver circuitry is typically formed upon monolithic integrated circuits. Assuming that an integrated circuit can be provided with 192 column output drivers, then a color VGA display screen requires 10 of such integrated circuits (10×192=1,920). One of the goals of circuit designers is to reduce the power consumption of such integrated circuits, both to minimize power drain on the batteries supplying such power and to reduce the power dissipated within the integrated circuit, and hence reduce the temperature at which such integrated circuit operates.

Integrated circuits which serve as column drivers (or "source drivers") for active matrix LCD displays generate different output voltages to define the various "gray shades" on a liquid crystal display. These varying analog output voltages vary the shade of the color that is displayed at a particular point, or pixel, on the display. The column driver integrated circuit must drive the analog voltages onto the columns of the display matrix in the correct timing sequence. A preferred circuit for generating such analog voltages is described in co-pending U.S. patent application Ser. No. 183,474, filed Jan. 18, 1994, entitled "INTEGRATED CIRCUIT FOR DRIVING LIQUID CRYSTAL DISPLAY USING MULTI-LEVEL D/A CONVERTER" and assigned to the assignee of the present application.

Liquid crystal displays (LCD's) are able to display images because the optical transmission characteristics of liquid crystal material change in accordance with the magnitude of the applied voltage. However, the application of a steady DC voltage to a liquid crystal will, over time, permanently change and degrade its physical properties. For this reason, it is common to drive LCDs using drive techniques which charge each liquid crystal with voltages of alternating polarities relative to a common midpoint voltage value. It should be noted that, in this context, the "voltages of alternating polarities" does not necessarily require the use of driving voltages that are greater than, and less than, ground potential, but simply voltages which are above and below a predetermined median display bias voltage. The application of alternating polarity voltages to the pixels of the display is generally known as inversion.

Thus, driving a pixel of liquid crystal material to a particular gray shade actually involves two voltage pulses of equal magnitude but opposite polarity relative to the median display bias voltage. The driving voltage applied to any given pixel during its row drive period of one display cycle is typically reversed in polarity during its row drive period on the next succeeding display cycle. Thus, for a given pixel located in a particular row, the voltage applied thereto might be +6 volts on a first display cycle and −6 volts on the next display cycle. Over time, the average voltage to which the pixel is driven is a median bias point halfway between the positive and negative voltages; in the example set forth above, the median bias voltage is zero volts or ground.

Assuming that a pixel is initially charged to +6 volts during a first display cycle, then during the following display cycle, the column driver circuit that drives the column which intersects the corresponding row where such pixel is located must drive the pixel from its prior value of +6 volts all the way down to −6 volts, a negative transition of 12 volts. On the third display cycle, the column driver circuit will need to drive the same pixel from −6 volts back to the initial +6 volts (or to some other voltage above the median bias voltage if information is to be updated), a positive transition of as much as 12 volts. The same is true for the other 639 pixels (or the other 1,919 pixels, in the case of a color display) located in the same row, as well as for the pixels located in the other 479 rows. These relatively large voltage transitions result in significant power usage which must be sourced by the column driver circuits.

While the most trivial inversion scheme would be one in which every pixel on the display is first driven to its positive value during a first display cycle, and then driven to its negative value during the second display cycle, this scheme may cause the LCD to alternately display two slightly different images, which could be perceived by the viewer as a flicker in the display. Thus, more complex row inversion schemes are commonly employed to reduce or eliminate any such flickering. Typically, a row inversion technique is used such that, during a display cycle, the driving voltages applied to the columns of the array will alternate in polarity between successive row drive periods. Thus, if the pixels in a first row are driven with positive voltages during the first row drive period, then the pixels in the adjacent second row will be driven with negative voltages during the second row drive period, and so forth. During the next display cycle, the polarities are reversed. Hence, during the second display cycle, the pixels in the first row are driven with negative voltages during the first row drive period, and the pixels in the adjacent second row are driven with positive voltages during the second row drive period, and so forth.

When the row inversion scheme described above is used, a given column driver may, for example, need to establish +6 volts on its associated column during the first row drive period of the first display cycle, and then need to establish −6 volts on the same column during the immediately following row drive period. Thus, the column driver must transition from +6 volts to −6 volts, and back again, for every row drive cycle in every display cycle. These relatively large and frequent voltage transitions consume significant amounts of power.

An even more complex inversion scheme is also known to those skilled in the art whereby the voltage applied to each pixel is of opposite polarity from every other pixel adjacent thereto. In other words, if a pixel is charged with a positive polarity voltage, then the adjacent pixels within the same row are charged with negative polarity voltages, and the adjacent pixels in the same column but in the preceding and following rows are also charged with negative polarity voltages, thus forming a "checkerboard" pattern of voltages. In this checkerboard scheme, column driver integrated circuits are typically disposed at both the top and bottom of the display, and drive alternating columns. For example, in a typical 480 row×1920 column display, the odd-numbered columns 1, 3, 5, . . . , 1919 are driven from the column driver I.C.'s at the top of the display, while even-numbered columns 2, 4, 6, . . . , 1920 would be driven from the bottom of the display. Since most known column driver I.C.'s allow for global polarity control (i.e. all outputs will drive high, or all outputs will drive low), then it is straightforward to drive adjacent display columns with opposite polarity driving voltages during a given row drive period by simply inverting a global polarity control signal between the top and bottom column drivers of the display.

The aforementioned global polarity control signal can be alternated between high and low logic levels between successive row drive cycles to invert the polarity of the driving voltage on a given column for every row drive period; thus, during a first row drive period, column 1 may be driven positive, and column 2 may be driven negative, while during the second row drive period, column 1 is driven negative, and column 2 is driven positive. This manner of operation may be viewed as column inversion. If this is done in conjunction with the row inversion technique described above, then the voltage polarity on the pixels of the display will alternate, at any one time, in a "checkerboard" fashion, such that no pixel is driven with the same polarity voltage as any of its neighbors.

For optimum performance, an active matrix liquid crystal display (AMLCD) should be driven with voltages ranging between +/−6 Volts with respect to the median bias point. While this voltage range is certainly attainable with known integrated circuit column drivers, it typically precludes the use of small geometry integrated circuit processes, which only support operation at 5 Volts or less. Since column drivers capable of supplying driving voltages exceeding 5 volts must be fabricated using larger geometry processes, available column driver integrated circuits for driving active matrix displays are typically larger and, therefore, more expensive to produce.

In order to avoid such additional expense, it is known to employ an AC drive technique which allows the use of 5 Volt process technology for fabrication of column driver I.C.'s. This AC drive technique relies upon the column drivers themselves to supply only a portion of the total drive voltage which appears across the liquid crystal pixels. The balance of the voltage across each pixel is supplied by driving the backplane display bias voltage with an AC waveform that is out of phase with the column drivers. Consequently, when the column drivers are outputting a positive polarity voltage, the backplane bias voltage is driven by a negative polarity voltage. The resulting voltage across each liquid crystal pixel is the sum of the voltage generated by the column driver plus the backplane bias voltage.

This AC drive technique generally requires that the polarity of the backplane bias voltage be reversed, and that the polarity of the column drivers also be reversed, following each row drive period. The circuit which drives the backplane bias voltage must switch from, for example, +8 volts to −2 volts between the first and second row drive periods, and from −2 volts back to +8 volts between the second and third row drive periods. In each case, the backplane voltage driver must switch through a transition of ten volts. As the backplane of the display has a significant amount of capacitance associated therewith, a significant amount of power is consumed to continuously switch the backplane bias voltage between successive row drive periods.

Accordingly, it is an object of the present invention to provide a column driver circuit for driving the columns of a liquid crystal display matrix and which reduces the power consumed from a power source when applying alternating polarity drive voltages to the columns of the LCD matrix.

It is another object of the present invention to provide such a circuit which reduces the power dissipated within such circuit when applying alternating polarity drive voltages to the columns of the LCD matrix.

A further object of the present invention is to provide such a power-saving circuit compatible with known row inversion driving schemes for LCD displays.

A still further object of the present invention is to provide such a power-saving circuit compatible with known column inversion driving schemes for LCD displays.

A yet further object of the present invention is to provide such a power-saving circuit for reducing the power consumed by an active matrix LCD display wherein the backplane bias voltage of the display is driven using the AC drive technique described above.

Still another object of the present invention is to provide a method for driving liquid crystal displays which reduces power consumption.

These and other objects of the present invention will become more apparent to those skilled in the art as the description of the present invention proceeds.

SUMMARY OF THE INVENTION

Briefly described, and in accordance with a preferred embodiment thereof, one aspect of the present invention relates to a power-saving column driver circuit for applying driving voltages to the columns of an arrayed liquid crystal display. The column driver circuit includes a number of voltage drivers corresponding to the number of columns in the liquid crystal array. Each of the voltage drivers provides a driving voltage to be applied to a given column of the liquid crystal display during a given row drive period for controlling the pixel located at the given column within the selected row. The voltage drivers provide a driving voltage that alternates in polarity between a most-positive voltage and a least-positive voltage; the midpoint between the most-positive voltage and least-positive voltage corresponds to a median bias voltage.

A clocked control signal is switched between first and second states during at least some row drive periods, and preferably during every row drive period, thereby dividing each such row drive period into first and second portions. The column driver circuit also includes a number of multiplexers corresponding to the number of columns in the display. Each of such multiplexers has a column terminal coupled to one of the columns of the liquid crystal display, an input terminal coupled to an associated voltage driver for receiving the voltage to be applied to a given column of the liquid crystal display during a given row drive period, and a common terminal. The common terminals of all of the multiplexers are coupled to a common node.

Each of the multiplexers responds to the clocked control signal by electrically coupling the column terminal to the common terminal, and hence, to the common node, during one portion of each row drive period, and by electrically coupling the column terminal to the input terminal during the remaining portion of each row drive period.

In one embodiment of the present invention, a storage capacitor is coupled to the common node, and hence, to the common terminal of each of the multiplexers. Assuming that the column driver circuit is constructed as a monolithic integrated circuit, then the storage capacitor is preferably located externally from the integrated circuit. The value of the storage capacitor is preferably selected to be greater than the capacitance associated with each column when multiplied by the number of columns in the array. During one of the portions of each row drive period, the multiplexers connect each of the columns of the liquid crystal display to the storage capacitor for effectively discharging each pixel in the selected row to the median bias voltage. During the remaining portion of each row drive period, the multiplexers couple the driving voltages produced by the associated voltage drivers to the columns of the display.

Assuming that a row inversion driving technique is being used (i.e., that the voltage drivers provide a driving voltage that is of one polarity during one row driving period for a selected row, and provide a driving voltage of an opposite polarity during a next row driving period for the next succeeding row), then the driving voltages applied to the columns alternate polarity from one row drive period to the next. Electrical charge stored on the storage capacitor upon the discharge of a positively charged pixel toward the median bias voltage during one row drive period is saved and used to charge a negatively-charged pixel back toward the median bias voltage during a following row drive period. Power is conserved because the voltage drivers need not supply the power to charge or discharge a pixel back to the median bias voltage before driving the pixel to the opposite polarity voltage.

For example, if a pixel within the display is to be switched from +6 volts to −6 volts, the storage capacitor discharges the pixel from +6 volts to approximately ground while storing the charge formerly held by the pixel. During the remaining portion of the row drive period, the voltage driver associated with the column in which such pixel is located need only drive the pixel voltage half as far, i.e., from ground potential to −6 volts. This effectively reduces the capacitive load on the column driver integrated circuit, and allows the column driver output stage to operate with half the power usually required.

When the column driver circuit of the present invention includes an external storage capacitor as described above, one terminal of such capacitor is coupled to the common node; the second terminal of such capacitor is preferably coupled to either a source of the median bias voltage, or to a system battery terminal, to form a closed electrical loop when charge is sourced by, or sunk by, the external storage capacitor.

In the form of the invention described above, the external storage capacitor acts as a source and/or sink of electrical charge; the storage capacitor stores and integrates the sum of the charges sourced from, and sunk by, the capacitor. An electrical battery may also serve a similar function. Thus, in another form of the present invention, the common node of the above-described column driver circuit is coupled to a terminal of an electrical battery which normally sources the median bias voltage.

The column driver circuit of the present invention is also compatible with column inversion driving methods wherein adjacent columns in the LCD display are driven by driving voltages of opposite polarities during any given row drive period. For the reasons explained below, the present invention can be used in conjunction with such column inversion driving techniques without requiring the presence of the aforementioned storage capacitor. During any particular row time, it his highly probable that the sum of the voltages from columns driven with the positive polarity will approximately equal the sum of the absolute values of the voltages of columns driven with the negative polarity. Stated simply, the average voltage of all of the columns will be near zero volts with respect to the median display bias.

Thus, in the case of column inversion, if all of the columns in the display are shorted to the common node through their respective multiplexer, the columns will discharge to a voltage near the median display bias, even in the absence of an external storage capacitor. The exact value of the voltage will vary for each row period, depending upon the information displayed by the columns during the previous row drive period. Note that the presence of the aforementioned storage capacitor is not necessary under these conditions.

The multiplexers may be formed using conventional integrated circuit MOSFET components. For example, a multiplexer may include first and second CMOS transmission gates, the first CMOS transmission gate being coupled between the column terminal and the common terminal for selectively coupling a column of the liquid crystal display to the storage capacitor. The second CMOS transmission gate is coupled between the column terminal and the associated voltage driver for selectively coupling the driving voltage produced by the voltage driver to its associated column.

Alternatively, each multiplexer may instead include first and second MOS transistors (n-channel or p-channel), wherein the drain terminals of both such transistors are coupled in common to a column. The gate terminals of the first and second transistors are coupled to the clocked control signal and to its complement, respectively, for alternately rendering one or the other of the first and second transistors conductive. The source terminal of one of the first and second transistors is coupled to the common terminal, and the source terminal of the other transistor is coupled to an associated voltage driver.

The multiplexers described above can also effectively be provided by using voltage drivers which themselves have a control input for selectively disabling the output terminal of the voltage driver. In this instance, the clocked control signal is coupled to the control input of the voltage drivers to disable the output of the voltage drivers during the portion of the row drive period when the columns are electrically coupled to the common node. Transmission gates are also provided to selectively couple the columns to the common node. The transmission gates each have a control terminal responsive to the clocked control signal. Each such transmission gate has a column terminal coupled to one of the columns of the liquid crystal display, and a common terminal coupled to the common node. The transmission gates electrically couple the columns of the display to the common node during one portion of each row drive period. During the remaining portion of the row drive period, the transmission gates decouple the columns from the common node while the voltage driver outputs are enabled. These transmission gates may be formed, for example, as single MOSFET (n-channel or p-channel) transistors or as CMOS transmission gates.

The present invention also relates to a method of driving columns in an arrayed liquid crystal display while conserving power. This method includes the step of selecting one row of pixels within the array to be driven, and applying driving voltages of a first polarity to columns of the array for driving pixels in the selected row. Either before or after driving such columns, such columns are temporarily electrically coupled to a first common node to charge or discharge the pixels in the selected row toward the median bias voltage. The next row of pixels within the array is then selected for application of driving voltages of an opposite polarity to the columns for driving pixels in the currently selected row. Once again, either before or after driving such columns, such columns are temporarily electrically coupled to the first common node to charge or discharge the pixels in the currently selected row toward the median bias voltage. These steps are repeated for remaining pairs of rows within the array. The aforementioned method may include the step of coupling a storage capacitor to the common node. Alternatively, such method may include the step of coupling the common node to a battery terminal sourcing the median bias voltage.

The method described in preceding paragraph is compatible with the above-described column inversion driving technique. In this case, a first group of at least two columns (for example, the odd-numbered columns) receive positive polarity driving voltages, and a second group of at least two columns (e.g., the even-numbered columns) receive negative polarity driving voltages when the first row is selected. When the next row is selected, the polarities of the driving voltages on the first and second groups of columns are reversed.

Assuming that the above-described column inversion driving technique is used, all columns may be shorted to the same common node. Since half of such columns were charged to a positive polarity voltage during the previous row drive period, and the other half of such columns were charged to a negative polarity voltage during the previous row drive period, the sum of such column voltages will average to a voltage near the median bias voltage, even if no storage capacitor is coupled to the common node. If desired, however, all of the columns may be shorted to the storage capacitor or battery terminal described above to ensure that all of the columns will be charged to, or discharged to, approximately the median bias voltage. Moreover, it is also possible, if desired, to short the first group of columns (i.e., the odd-numbered columns) to a first storage capacitor, and to short the second group of columns (i.e., the even-numbered columns) to a second storage capacitor.

Another aspect of the present invention relates to a power-saving circuit and method for driving the backplane bias voltage of an active matrix liquid crystal display panel of the type described above. In many applications, a display bias driver generates alternating polarity bias voltages for application to the backplane of the active matrix liquid crystal display panel during corresponding alternating row drive periods. The alternating polarity bias voltage switches between a most-positive bias voltage during one row drive period and a least-positive bias voltage during a next row drive period, and back again to the most-positive bias voltage during the third row drive period. The midpoint between the most-positive bias voltage and said least-positive bias voltage corresponds to a median bias voltage.

In the aforementioned power saving circuit and method for driving the backplane of the display, a clocked control signal divides each row drive period into first and second portions. A multiplexer has a backplane terminal coupled to the backplane of the liquid crystal display panel, a driver terminal coupled to the output of the display bias driver, and a storage terminal coupled to a storage capacitor. The multiplexer is responsive to the clocked control signal for selectively electrically coupling the backplane terminal to the storage capacitor during one portion of each row drive period, and for selectively electrically coupling the backplane terminal to the output of display bias driver during the remaining portion of each row drive period.

Assuming that the power-saving backplane bias driver circuit is constructed as a monolithic integrated circuit, then the storage capacitor is preferably located externally from the integrated circuit. The value of the storage capacitor is preferably selected to be greater than the capacitance $C_{back}$ associated with the backplane of the liquid crystal display panel. The storage capacitor is preferably coupled between the common terminal of the multiplexer and a positive or negative terminal of the system battery to provide a closed loop path for charging or discharging the backplane capacitance toward the median bias voltage.

During one of the portions of each row drive period, the multiplexer connects the backplane terminal of the liquid crystal display to the storage capacitor for effectively discharging the backplane to the median bias voltage. During the remaining portion of each row drive period, the multiplexer couples the bias driver voltage to the backplane terminal of the display.

Assuming that the AC bias driving technique is being used for driving the backplane (i.e., that the bias voltage driver provides a driving bias voltage that is of one polarity during one row driving period for a selected row, and provides a driving bias voltage of an opposite polarity during a next row driving period), then the bias driving voltages applied to the backplane terminal alternate polarity from one row drive period to the next. Electrical charge stored on the storage capacitor upon the discharge of the positively charged backplane toward the median bias voltage during one row drive period is saved and used to charge the negatively-charged backplane back toward the median bias voltage during a following row drive period. Power is conserved because the bias voltage driver need not supply the power to charge or discharge the backplane back to the median bias voltage before driving the backplane to the opposite polarity bias voltage. As in the case of the column driver circuit described above, the multiplexer used to selectively couple the bias driving voltage or the storage capacitor to the backplane of the display may be formed by a pair of transmission gates, each of which may consist of an n-channel MOSFET, a p-channel MOSFET, or a CMOS transmission gate.

BRIEF DESCRIPTION OF THE DRAWINGS

FIG. 4 is a block diagram showing a preferred embodiment of a power-saving column driver integrated circuit incorporating the present invention.

FIG. 5 is a waveform timing diagram illustrating a clocked control signal dividing three row drive periods into first and second portions, and illustrating the voltages upon an external storage capacitor and upon one column in the array.

FIG. 6 is a more detailed schematic drawing of one of the column driver circuits shown in FIG. 4 and using n-channel MOSFET transistors to form a multiplexer.

FIG. 7 is a more detailed schematic drawing of one of the column driver circuits shown in FIG. 4 and using p-channel MOSFET transistors to form a multiplexer.

FIG. 8 is a more detailed schematic drawing of one of the column driver circuits shown in FIG. 4 and using a pair of CMOS transmission gates to form a multiplexer.

FIG. 9 is a more detailed schematic drawing of one of the column driver circuits shown in FIG. 4 and using a voltage driver having a gated output stage along with an n-channel MOSFET transistor to effectively form a multiplexer.

FIG. 10 is a block diagram of a power-saving backplane bias voltage driving circuit for driving the backplane of an active matrix LCD display.

DETAILED DESCRIPTION OF THE PREFERRED EMBODIMENTS

Figure 1:
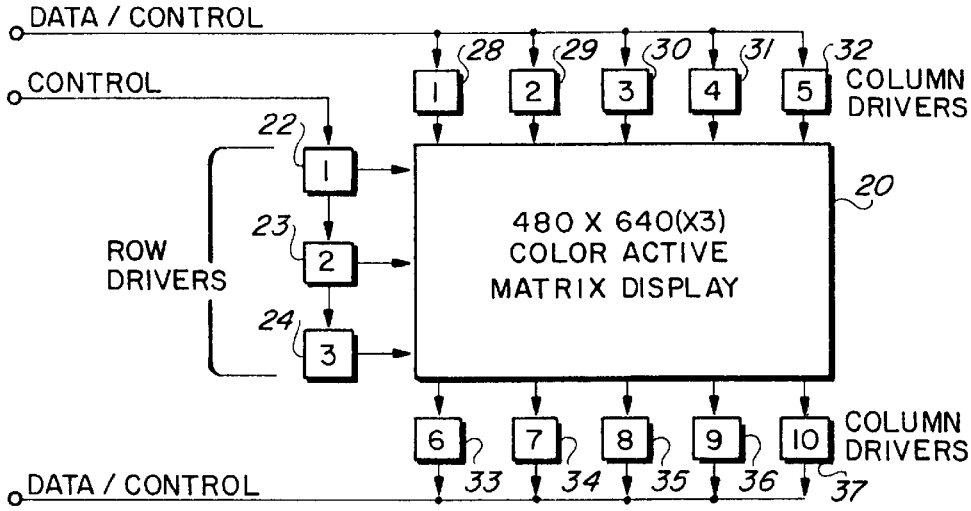
FIG. 1 is a block diagram of an active matrix LCD display including column and row driver circuitry for driving the array of pixels included within the LCD display.

Shown in FIG. 1 is a typical active matrix display system. The active matrix LCD display screen itself is designated by reference numeral 20 and may include an arrayed matrix of 480 rows and 640 columns for a typical black and white gray-scale LCD display. For a typical color LCD display, there are three times the number of columns, or 1,920 columns, to provide for three primary colors at each point in the display screen. The intersection of each row and each column is called a pixel, and a thin film transistor (TFT) is provided at each such intersection to selectively couple the voltage on each column to a sampling capacitor at each pixel when each row is selected. The intensity of each pixel is selected by controlling the voltage applied to the sampling capacitor at each pixel of the display.

During each refresh phase, or display cycle, of the display, each of the 480 rows is successively selected by row drivers 22, 23, and 24 for enabling the thin film transistors in the selected row and allowing the voltages present on the 640 columns to be stored upon the storage capacitors at each of the 640 pixels in the selected row. As shown in FIG. 1, ten column driver integrated circuits 28–37 each drive 64 of the 640 columns in the black and white LCD display (or 3 times 64, or 192 columns, for a color display). Five of these column drivers (28–32) are shown, for purposes of illustration, being positioned above the array, and the remaining five column drivers (33–37) are shown below the array. A control circuit (not shown) provides data and control signals to the row drivers 22–24 and column drivers 28–37 to synchronize such components in order to display a desired image. The basic drive circuitry shown in FIG. 1 is known in the art and does not itself form a part of the present invention.

Figure 2:
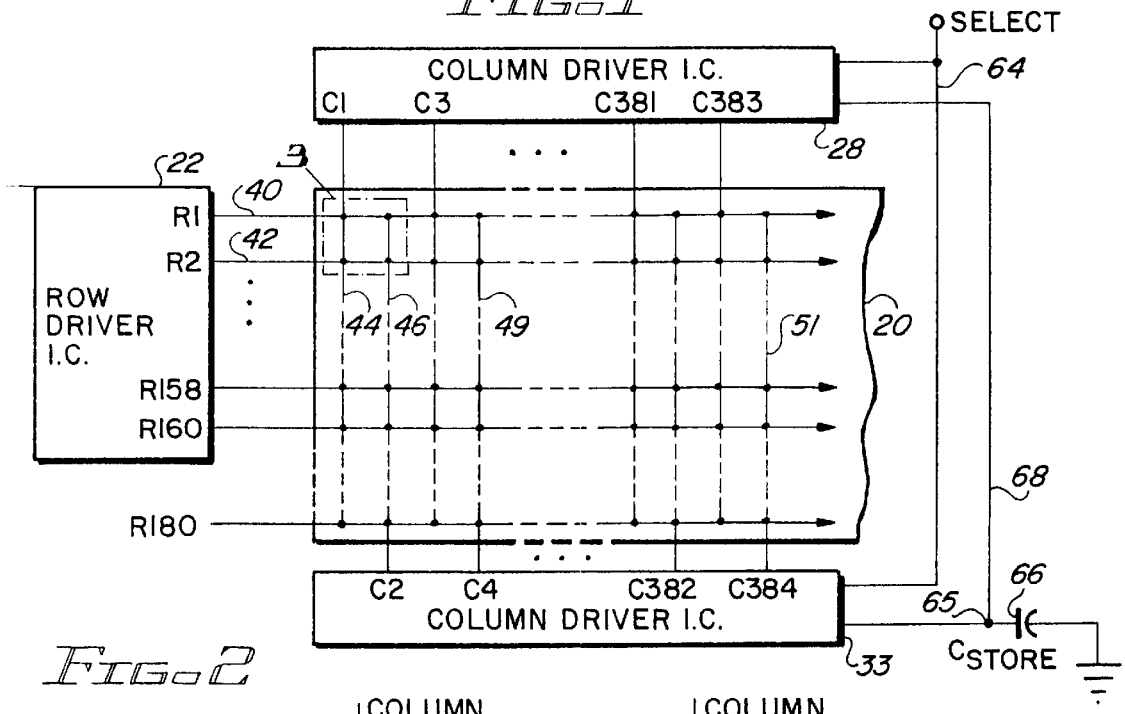
FIG. 2 is a more detailed block diagram of a portion of FIG. 1 including two column driver integrated circuits, one row driver integrated circuit, and several of the row and column conductors of the active matrix display.

Referring to FIG. 2, row driver integrated circuit 22 and column driver integrated circuits 28 and 33 are shown driving 160 rows and 384 columns, respectively, of active matrix color display 20. The rows and columns intersect each other to define pixels at the intersection points thereof. Four such intersection points are shown within the dashed block labeled FIG. 3. Rows 1 and 2 are formed by conductors 40 and 42, respectively. Column 1 is formed by conductor 44 and is driven by upper column driver integrated circuit 28; adjacent column 2 is formed by conductor 46 which is driven by lower column driver integrated circuit 33.

Figure 3:
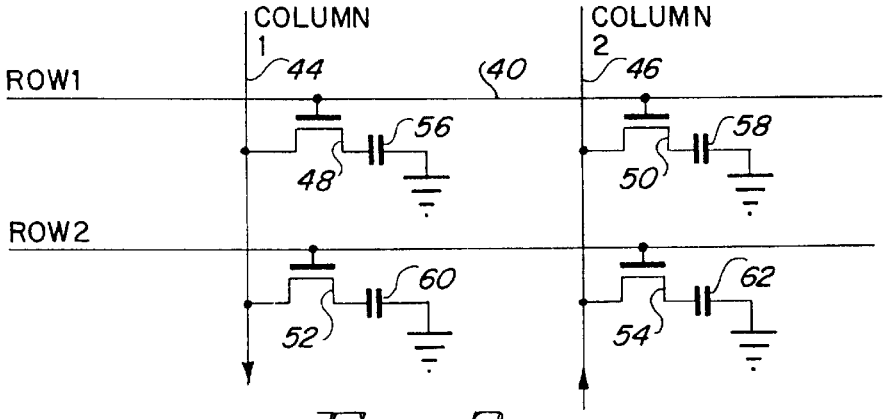
FIG. 3 is an enlarged drawing of the small portion of the active matrix display surrounded in dashed outline in FIG. 2, and showing the thin film transistors and sampling capacitors formed upon the display matrix.

Within FIG. 3, the portion of active matrix LCD display 20 formed by the intersection of row conductors 40 and 42 and column conductors 44 and 46 is shown in greater detail. As shown in FIG. 3, row conductor 40 is coupled to the gate terminals of two MOS thin-film transistors (or TFTs) 48 and 50. Likewise, row conductor 42 is coupled to the gate terminals of two thin-film transistors 52 and 54. Column conductor 44 is coupled to the drain terminals of transistors 48 and 52, and column conductor 46 is coupled to the drain terminals of transistors 50 and 54. When the pixels formed at the intersection of row conductor 40 and column conductors 44 and 46 are to be refreshed and/or updated, row conductor 40 is driven high to enable TFTs 48 and 50; in this instance, the column driver output voltage applied to column conductor 44 is applied through enabled TFT 48 to sampling capacitor 56 for storing the analog voltage corresponding to the desired gray shade for such pixel. Similarly, the column driver output voltage applied to column conductor 46 is applied through TFT 50 to sampling capacitor 58 for storing the analog voltage corresponding to the desired gray shade for such pixel. When row conductor 40 is returned low, TFTs 48 and 50 are turned off, and the analog voltages applied to storage capacitors 56 and 58 are retained until they are updated by a subsequent refresh cycle. Row conductor 42 is then enabled, and the analog voltages applied to column conductors 44 and 46 are updated to apply the desired gray shade voltages to be stored on storage capacitors 60 and 62, respectively.

As mentioned above, row inversion driving schemes are commonly used to avoid application of a continuous non-zero DC voltage to the liquid crystal material. Referring to FIG. 2, row 1, or row conductor 40, is selected during a first row drive period, while row 2, or row conductor 42, is selected during a second row drive period. After 480 row drive periods, the first display cycle is completed, and a second display cycle begins.

Assuming the use of simple row inversion without column inversion, then during the first display cycle, and while row 1 is selected corresponding to the first row drive period, positive polarity voltages are applied to all column conductors, including columns 1 and 2 (conductors 44 and 46, respectively); accordingly, pixels in row 1, including sampling capacitors 56 and 58 (see FIG. 3) are charged positively. During the next row drive period, row 2 is selected; now, however, negative polarity voltages are applied to all of the column conductors, including columns 1 and 2 (conductors 44 and 46, respectively); accordingly, pixels in row 2, including sampling capacitors 60 and 62 (see FIG. 3) are charged negatively. This process is repeated for the remaining 239 pairs of rows within the array. During the following display cycle, row 1 is again selected, only this time, negative polarity voltages are applied to all of the column conductors, including columns 1 and 2 (conductors 44 and 46, respectively); accordingly, pixels in row 1, including sampling capacitors 56 and 58 (see FIG. 3) are now charged negatively. Likewise, during the next row drive period, row 2 is selected, but positive polarity voltages are applied to all of the column conductors, including columns 1 and 2 (conductors 44 and 46, respectively); accordingly, pixels in row 2, including sampling capacitors 60 and 62 (see FIG. 3) are now charged positively. Thus, over time, the DC voltage applied to each pixel averages to a median bias voltage, which may be zero volts.

When the row inversion scheme described above is used, column driver circuit 28 needs to establish, for example, +6 volts on column 1 (conductor 44) during the first row drive period of the first display cycle, and then may need to establish, for example, −6 volts on the same column 1 during the immediately following row drive period for row 2. Thus, in this example, column driver circuit 28 must transition from +6 volts to −6 volts, and back again, for every row drive cycle in every display cycle. Each of the column driver circuits for column 2 through column 1,920 must do the same. As indicated above, it is one of the goals of the present invention to reduce the power drawn from the power source, and consumed within the column driver circuits, when making such transitions.

FIG. 2 shows a modification to conventional integrated circuit column drivers for the purpose of reducing such power consumption. As indicated in FIG. 2, a clocked control signal 64, or SELECT, is routed to all of the column driver integrated circuits, including column drivers 28 and 33 shown in FIG. 2. Referring briefly to FIG. 5, the SELECT signal divides each row drive period into two phases or portions. The first portion is represented in FIG. 5 for the first row drive period by the period between times t0 and t1, during which the SELECT signal is high. The second portion is represented in FIG. 5 by the period between t1 and t2 during which the SELECT signal is low. Clocking circuits for generating such clocked control signals are well known to those skilled in the art, and are described in greater detail in "*Digital Integrated Electronics*", Herbert Taub and Donald Schilling, McGraw-Hill, 1977, pp. 544–565, the subject matter of which is hereby incorporated by reference. In addition, as shown in FIG. 2, a common node 65 is coupled by a common line 68 to a common terminal of each integrated circuit column driver; as further shown in FIG. 2, an external storage capacitor 66 may be coupled between ground and common node 65. The manner by which the SELECT signal, common node 65, and external storage capacitor 66 help reduce power is explained below in conjunction with FIGS. 4 and 5.

In FIG. 4, a portion of column driver integrated circuit 33 is shown in greater detail. Column driver circuit 33 includes a box labeled 70 which stores the analog voltage that is to be driven onto column 2 (conductor 46). Likewise, column driver circuit 33 includes boxes labeled 72 and 74 which store the analog voltages that are to be driven onto column 4 and column 384 of the LCD array. Box 70 provides its analog voltage to an input of a unity gain amplifier 76 which reproduces such analog voltage at its low impedance output for driving the voltage onto column 2. Box 70 and unity gain amplifier 76 may collectively be viewed as a voltage driver. Ordinarily, the output of the unity gain amplifier would be directly coupled to column 2 (conductor 46) for applying a driving voltage directly thereto. However, as shown in FIG. 4, a 2:1 multiplexer 78 is inserted between the output of unity gain amplifier 76 and conductor 46. Identical multiplexers 80 and 82 are inserted between unity gain amplifiers 84 and 86 and columns 4 and 384, respectively.

Multiplexer 78, and multiplexers 80 and 82, each include four terminals. Multiplexer 78 includes a column terminal 88 connected to column 2 of the array, an input terminal 90 connected to the output of its associated unity gain amplifier 76, a common terminal 92 connected to common line 68 and to common node 65, and a control terminal 94 for receiving the SELECT signal 64. Multiplexer 78 functions to electrically couple column terminal 88 to common terminal 92 when the SELECT signal is high. Conversely, multiplexer 78 electrically couples column terminal 88 to input terminal 90 when the SELECT signal is low. Multiplexers 80 and 82 function in a similar manner.

Multiplexers 78–82 electrically couple each of columns 2, 4, and 384 of the liquid crystal display to common node 65 (and optionally, to external storage capacitor 66) at the beginning of each row drive period when the SELECT signal is high. Within FIG. 4, the load capacitance associated with column 2 ($C_{col}$), including the capacitance of the sampling capacitor of the pixel in the selected row, are represented by capacitor 96 shown in dashed outline. The value of storage capacitor 66 is selected to be much larger than N times the value of $C_{col}$, where N is the number of columns in the array, and $C_{col}$ is the load capacitance typically associated with one column in the array. During the first portion of the row drive period, charge stored on load capacitance 96 is discharged to external storage capacitor 66. Likewise, charges stored on load capacitances 98 and 100 of columns 4 and 384 are also discharged to external storage capacitor 66 during this first portion of each row drive period. Hence, storage capacitor 66 acts like a large charge sink. If a row inversion drive method is utilized, then each column driver must alternate between driving high and low voltages at each row drive period. Because this method is not random (i.e. an unknown voltage at each row drive period), but has a definite polarity shift between row drive periods, the energy to drive the column load high may be recouped and saved to drive the subsequent column load low, and vice-versa.

The external storage capacitor 66 averages the voltages, over time, applied to the columns of the array. Due to the row inversion driving technique described above, the average voltage charged on external capacitor 66 is the median bias voltage that lies midway between the most-positive and most-negative voltages applied to the columns of the array. For example, if the most-positive voltage is +6 volts and the least-positive voltage is −6 volts, then the median bias voltage is zero volts, and the external storage capacitor will remain at or near zero volts.

Preferably, capacitor 66 is coupled between common line 68 and a source of such median bias voltage, in this case, ground potential. If a source of the median bias voltage is not readily available, then the second terminal of storage capacitor 66 is preferably coupled to a system battery terminal to form a closed loop path for charging and discharging the load capacitance associated with the columns. During the first portion of each row drive period, the pixels in the selected row of the array discharge down to (or charge up to) zero volts, in this example. All charges previously held by such pixels are transferred to storage capacitor 66.

During the second portion of each row drive period, when SELECT is low, multiplexer 78 switches to couple the driving voltage produced by unity gain amplifier 76 onto column 2 for charging the pixel in the selected row. For purposes of illustration, it will be assumed that the pixel at row 1, column 2, was previously charged to +6 volts, and that during the present row drive period, such pixel is to be driven to −6 volts. However, instead of charging such column (and its associated pixel) from +6 volts up to −6 volts as is true in known column driver circuits, unity gain amplifier 76 need only charge column 2 from zero volts down to −6 volts because column 2 was already discharged from +6 volts down to zero volts during the first portion of the row drive period.

The above-described operations are generally illustrated in FIG. 5 wherein, immediately prior to time t0, the voltage on Column 2 is shown as being +6 volts. At time t0, row 1 is selected, and SELECT goes high, shorting column 2 through mutliplexer 78 to external storage capacitor 66, and dropping the voltage on Column 2 to approximately ground potential. The voltage on the external storage capacitor $C_{store}$ is shown in FIG. 2 as rising slightly following time t0 as it sinks positive charges from Column 2 and the other columns. In practice, the value of external capacitor 66 is large enough to sink such charges without producing a noticeable variation in the voltage thereacross. At time t1, the second portion of the row drive period begins, and multiplexer 78 couples the output of unity gain amplifier 76 to Column 2, thereby driving column 2 down from zero volts to −6 volts. Row 2 is deselected just before time t2 to save the charges stored on the pixels in Row 1. At time t2, the next row drive period begins, Row 2 is selected. The pixel at row 2, column 2, was previously charged to a negative voltage, due to the use of the row inversion driving scheme. Thus, at time t2, the voltage on column 2 is charged by external capacitor 66 from −6 volts back to ground, and the voltage on $C_{store}$ is shown in FIG. 5 as falling slightly because external capacitor 66 is sourcing, rather than sinking, charge. During the second portion of the second row drive period, between times t3 and t4, multiplexer 78 couples the output of unity gain amplifier 76 to Column 2, thereby driving column 2 up from zero volts to +6 volts. Row 1 is deselected just before time t4 to save the charges stored on the pixels in Row 2. This process repeats for the remaining rows. During the following display cycle, the driving voltage applied to Column 2 by unity gain amplifier 76 during the drive period for Row 1 is reversed in polarity relative to the driving voltage applied for Row 1 during the previous display cycle.

In the example described above, common node 65 was coupled to external storage capacitor 66. However, in an alternative embodiment, external storage capacitor 66 can be replaced with a battery terminal that sources the median bias voltage. Such a battery terminal acts like a storage capacitor by having an ability to some extent to source and sink charge, and to save and integrate charges that are sourced and sunk.

As explained below, the power savings achieved using the above-described column driving method is significant. To better understand such power savings, one must first understand how to compute the power consumed. Each liquid crystal pixel presents a capacitive load $C_{cool}$ that must be driven by the column driver circuit. The current required to drive a capacitive load is:

$$I_{AVG}=CL\times V_s\times F$$

where $I_{AVG}$ is the average current required, $C_L$ is the capacitive load, $V_s$ is the average voltage swing, and F is the frequency of operation. In an LCD panel, the total capacitive load will simply be the capacitance of an individual column, multiplied by the total number of columns being driven. The frequency of operation is simply the inverse of one display cycle (i.e., 480 row drive periods).

The average voltage swing of the pixels will depend upon the images that are displayed; however, in general:

$$V_S=V_{POS}+|V_{NEG}|$$

where $V_{POS}$ and $V_{NEG}$ are the magnitudes of the voltages in the positive and negative voltage ranges as referenced to the median display bias. Furthermore, over a number of display cycles, it must hold that $$\Sigma V_{POS}=\Sigma|V_{NEG}|$$

or, stated another way, the mean of all $V_{POS}$ values must equal the absolute value of the mean of $V_{NEG}$ values. It should also be noted that, in an active matrix LCD, there exists a "dead band" between the positive and negative voltage ranges such that each $V_{POS}$ and $|V_{NEG}|$ will always be greater than 0 V.

The average power required to drive the display is therefore:

$$P_{AVG}=V_{DD}\times I_{AVG}$$

where $V_{DD}$ is the power supply voltage. This analysis assumes that the load presented by the LCD is purely capacitive (i.e. no parasitic resistance), and does not address the power needed to bias the column driver integrated circuits.

Using a column driver circuit constructed in accordance with the teachings of the present invention results in approximately a 50% decrease in the average power required to drive the display during normal operation. In the above example, it was assumed that the LCD column was required to slew from the midpoint, or mean, of the range of positive polarity voltages to the midpoint, or mean, of the range of negative polarity voltages, and vice-versa. While this will not be the case for each individual voltage transition, over time, the mean positive voltage must equal the mean negative voltage. Therefore, the described column driver circuit effectively reduces the average voltage transition by a factor of two by slewing the voltage on each column to (nearly) the median display bias at each transition. This effectively divides the voltage swing $V_S$ by two. The average current required to drive the capacitive load therefore becomes $$I_{AVG}=(C_L\times V_S/2\times F)$$

which implies a 50% reduction in the power required from $V_{DD}$.

As mentioned above, when the capacitive loads are shorted to the external capacitor 66 ($C_{store}$) they are driven to a voltage that is near to the median display bias. If all N column driver outputs were at voltage $V_{POS}$, then upon connection with $C_{store}$, they would be driven to a voltage $V_H$ such that $$N\times C_{col}\times(V_{POS}-V_H)=C_{store}\times(V_H-V_M)$$

where $V_M$ is the median display bias. If $C_{store} >> N \times C_{col}$, then $$(V_{POS}-V_H) >> (V_H-V_M)$$

which implies that $V_H-V_M$ is a small number, and that the voltage on external storage capacitor 66 does not shift significantly from the median bias voltage.

The circuit of FIG. 4 was simulated using the PSPICE circuit simulation program. These simulations confirm the approximate 50% reduction in supply current as predicted. Furthermore, they show that the circuit operation is fairly insensitive to the device sizes used in the 2:1 multiplexers.

Incidentally, while FIG. 5 defines a row drive period as beginning at t0 when SELECT goes high, one could also define a row drive period as beginning at time t1 when SELECT goes low; in this latter case, each row drive period would begin with the voltage drivers applying desired voltages to the columns of the array, followed by deselection of the row just before time t2. At time t2, the new row is selected, and the columns are shorted to the external storage capacitor in preparation for the next "row drive period".

FIGS. 6, 7, 8, and 9 show alternate forms of circuitry which may be used to provide multiplexer 78 of FIG. 4. In FIG. 6, multiplexer 78 is formed by first and second n-channel MOS transistors 102 and 104. The drain terminals of transistors 102 and 104 are coupled in common to column 2 and the load capacitance 96 associated therewith. The gate terminal of first transistor 102 is coupled to the SELECT signal, while the gate terminal of second transistor 104 is coupled to the complement of the SELECT signal. The source terminal of first transistor 102 is coupled to external storage capacitor 66, and the source terminal of second transistor 104 is coupled to the output of unity gain amplifier 76. When SELECT is high, transistor 102 is conductive, and transistor 104 is non-conductive. When SELECT is low, transistor 102 is non-conductive, and transistor 104 is conductive.

FIG. 7 shows multiplexer 78 constructed from first and second p-channel MOS transistors 106 and 108. The drain terminals of transistors 106 and 108 are coupled in common to column 2 and the load capacitance 96 associated therewith. The gate terminal of first transistor 106 is coupled to the complement of the SELECT signal, while the gate terminal of second transistor 108 is coupled to the SELECT signal. The source terminal of first transistor 106 is coupled to external storage capacitor 66, and the source terminal of second transistor 108 is coupled to the output of unity gain amplifier 76. When SELECT is high, transistor 106 is conductive, and transistor 108 is non-conductive. When SELECT is low, transistor 106 is non-conductive, and transistor 108 is conductive.

FIG. 8 shows multiplexer 78 constructed from first and second conventional CMOS transmission gates 110 and 112. First CMOS transmission gate 110 is coupled between column 2 (and the load capacitance 96 associated therewith) and external storage capacitor 66. Second CMOS transmission gate 112 is coupled between column 2 (and the load capacitance 96 associated therewith) and the output of unity gain amplifier 76. When SELECT is high, transmission gate 110 is conductive, and transmission gate 112 is non-conductive. When SELECT is low, transmission gate 110 is non-conductive, and transmission gate 112 is conductive.

CMOS transmission gates 110 and 112 are shown in FIG. 8 by abbreviated symbols. Those skilled in the art will understand that each such CMOS transmission gate includes an n-channel transistor and a p-channel transistor coupled in parallel with each other, and wherein the gate terminals of the n-channel and p-channel transistors are coupled to the SELECT control signal and its complement, respectively. Additional details concerning such CMOS transmission gates may be found in "*Digital Integrated Electronics*", Herbert Taub and Donald Schilling, McGraw-Hill, 1977, pp. 479–481, the subject matter of which is hereby incorporated by reference.

FIG. 9 illustrates an alternative form of a multiplexer that effectively performs the same function as multiplexer 78 of FIG. 4. In FIG. 9, a modified form of unity gain amplifier 76' is shown which itself has a control input 114 for selectively enabling or disabling the output terminal thereof. The output terminal of unity gain amplifier 76' is directly coupled to column 2 (and the load capacitance 96 associated therewith). As shown in FIG. 9, the complement of the SELECT signal is coupled to control input 114 of unity gain amplifier 76' to disable (i.e., switch to a high impedance state) the output terminal thereof during the portion of each row drive period when the columns are electrically coupled to the storage capacitor. A transmission gate 116 is also shown in FIG. 9 coupled between external storage capacitor 66 and column 2 (and the load capacitance 96 associated therewith). Transmission gate 116 has a control terminal receiving the SELECT signal and selectively couples column 2 to storage capacitor 66 when the SELECT signal is high. During the remaining portion of the row drive period, when SELECT is low, transmission gate 116 decouples column 2 from external storage capacitor 66, while the output of unity gain amplifier 76' is enabled.

Within FIG. 9, transmission gate 116 is shown as an n-channel MOSFET transistor 118. However, those skilled in the art will appreciate that transmission gate 116 may be formed by a p-channel MOSFET transistor (see FIG. 7) or by a conventional CMOS transmission gate (see FIG. 8).

While the embodiment of a column driver circuit described thus far assumes that the upper column driver circuits (see 28–32 in FIG. 1) and lower column driver circuits (see 33–37 in FIG. 1) apply driving voltages of the same polarity as each other during any given row drive period, the present invention is also adapted for use with the more complex column inversion, or "checkerboard", driving technique described above. The only difference is that the global polarity control terminals (not shown) of the upper and lower groupings of column driver circuits are driven by complementary global control signals, thereby causing the driving voltages of the upper column driver output terminals to be opposite in polarity to those of the lower column driver circuits. As in conventional row inversion, the global polarity control signal and its complement are clocked at half the frequency of the row drive frequency for causing the polarity of the driving voltages produced by any particular column driver circuit to reverse in polarity from one row drive period to the next. As described above, when using this column inversion driving method in conjunction with standard row inversion, any two adjacent columns of the liquid crystal display are driven driving voltages of opposite polarities when the SELECT signal is low during each row drive period. In this case, the columns of the display may be shorted to common node 65 for discharging all columns to approximately the median display bias without connecting thereto either an external storage capacitor (such as storage capacitor 66), or a battery terminal sourcing the median bias voltage. During any active portion of any row drive period, half of the columns in the display are driven to a voltage above the median bias voltage, and the other half of the columns are driven to a voltage below the median bias voltage. Thus, the sum of the charges applied to the column load capacitances at the beginning of the next row drive period will approximately average to the median bias voltage.

If desired, more than one external storage capacitor may be used. For example, in the case described in the preceding paragraph, it may be desired to use a first external storage capacitor in conjunction with all upper column driver circuits 28–32 (see FIG. 1) for sinking charge from, and sourcing charge to, the odd-numbered columns in the array, while using a second external storage capacitor in conjunction with all lower column driver circuits 33–37 (see FIG. 1) for sinking charge from, and sourcing charge to, the even-numbered columns in the array.

As mentioned earlier, it is known to apply an AC bias voltage to the backplane of an active matrix liquid crystal display panel in order to reduce the amplitude of driving voltages applied to the columns of the display panel. Those skilled in the art are familiar with such AC driving techniques for applying an alternating bias voltage to the backplane of an active matrix liquid crystal display, as described in greater detail in Nagata S. et al. "Capacitively Coupled Driving of TFT-LCD", *Proc. SID*, 1989, pp. 242–245, and E. Takeda, Y. Nan-no, Y. Mino, A. Otsuka, S. Ishihara, S. Nagata, "Capacitively Coupled TFT-LCD Driving Method", *Proc. SID* 1990, p. 87; the subject matter of these two references is hereby incorporated herein by reference. A similar power-saving method can be used to drive the AC voltage applied to the backplane of an active matrix liquid crystal display panel. FIG. 10 illustrates such a power-saving driving method. Within FIG. 10, display bias driver 120 supplies an alternating polarity back bias voltage for application to the backplane of the active matrix liquid crystal display panel. Display bias driver 120 is clocked by a control signal 122 which switches at half the frequency of the row drive clock.

Assuming that the backplane of the LCD display switches between, for example, +8 volts and −2 volts, then display bias driver 120 generates an output of +8 volts during a first row drive period, an output of −2 volts during a second row drive period, an output of +8 volts during the third row drive period, and so forth until all 480 rows have been selected. However, during the next succeeding display cycle, the polarities of the voltages applied during a given row drive period are reversed. Thus, during the next display cycle, display bias driver 120 generates an output of −2 volts during the first row drive period, an output of +8 volts during the second row drive period, an output of −2 volts during the third row drive period, and so forth until all 480 rows have been selected. This process is repeated for additional display cycles. In the example described above, the median bias voltage applied to the backplane of the LCD display is simply the midpoint between the most-positive bias voltage (+8 volts) and the least-positive bias voltage (−2 volts), or +3 volts.

As shown in FIG. 10, the output of display bias driver 120 is coupled to a driver terminal 122 of multiplexer 124 for providing thereto the alternating back bias voltages to be applied to the backplane of the liquid crystal display panel. Multiplexer 124 also includes a control terminal 126 for receiving a clocked control signal which may be of the same form as the SELECT signal shown in FIG. 5. Multiplexer 124 also has a backplane terminal 128 coupled to the backplane of the liquid crystal display panel. In FIG. 10, the capacitive load associated with the backplane of the display is represented by capacitor 130 ($C_{back}$) shown in dashed lines. In addition, multiplexer 124 has a storage terminal 132 coupled to one electrode of external storage capacitor 134. The second electrode of external capacitor 134 is coupled to ground potential, or to some other system battery terminal. The value of the capacitance of the external storage capacitor 134 is selected to be much greater than the capacitance of capacitive load 130 ($C_{back}$). Multiplexer 124 can be constructed from conventional MOSFET transistors in the same manner previously described in conjunction with FIGS. 6–9.

During each row drive period, multiplexer 126 initially responds to the high level of the SELECT signal by electrically coupling the backplane terminal 128 to the storage terminal 132. In this manner, the backplane of the liquid crystal display panel is coupled to external storage capacitor 134 during the first portion of each row drive period. Any charge which was formerly placed on the backplane of the display, and stored by $C_{back}$, is discharged to external storage capacitor 134. For the same reasons previously discussed above in conjunction with the power-saving column driver circuit, the voltage on external storage capacitor will, over time, average to the median bias voltage, or zero volts in this example.

External storage capacitor 134 ($C_{store}$) alternatively serves as a charge sink or charge source, and effectively discharges the backplane from +2 volts to 0 volts, or charges the backplane from −2 volts to zero volts. After the SELECT signal switches low, the output of bias voltage driver 120 is electrically coupled by multiplexer 124 to the backplane of the liquid crystal display panel during each row drive period to apply the appropriate bias voltage thereto. Power is again conserved because bias voltage driver need only drive the backplane of the display half as far (i.e., from 0 volts to +2 volts, or from 0 volts to −2 volts) as in known bias voltage driver circuits.

While the present invention has been described with respect to a preferred embodiment thereof, such description is for illustrative purposes only, and is not to be construed as limiting the scope of the invention. Various modifications and changes may be made to the described embodiment by those skilled in the art without departing from the true spirit and scope of the invention as defined by the appended claims.

We claim:

1. A power-saving column driver circuit for applying driving voltages to a plurality of columns in a liquid crystal display, the liquid crystal display including an array of pixels arranged in rows and columns, and the liquid crystal display including row driver circuitry for selecting at least one row in the pixel array during a row drive period, the row driver circuitry selecting all rows in the pixel array at least once during a display cycle, said column driver circuit comprising in combination:

a. a plurality of voltage drivers, each of said plurality of voltage drivers providing a driving voltage to be applied to a given column of the liquid crystal display during a given row drive period for controlling the pixel located at the given column within the selected row;

b. clocking means for providing a control signal switching between a first state and a second state during at least one row drive period of each display cycle;

c. a plurality of multiplexers, each of such multiplexers having a control terminal coupled to said clocking means for receiving the control signal, each of such multiplexers having a column terminal coupled to one of the columns of the liquid crystal display, each of such multiplexers having an input terminal coupled to one of said plurality of voltage drivers for receiving the voltage to be applied to a given column of the liquid crystal display during a given row drive period, and each of such multiplexers having a common terminal, each of such multiplexers electrically coupling the column terminal thereof to the common terminal thereof when the control signal is in the first state, and each of such multiplexers electrically coupling the column terminal thereof to the input terminal thereof when the control signal is in the second state;

d. a common node coupled to the common terminal of each of said plurality of multiplexers;

e. said plurality of multiplexers electrically coupling each of the columns of the liquid crystal display to said common node when the control signal is in its first state, and said plurality of multiplexers coupling each driving voltage produced by said plurality of voltage drivers to a respective one of the columns when the control signal is in its second state.

2. The column driver circuit recited by claim 1 wherein said clocking means functions to switch the control signal between a first state and a second state during every row drive period of each display cycle, whereby said plurality of multiplexers electrically couple each of the columns of the liquid crystal display to said common node when the control signal is in its first state during every row drive period, and said plurality of multiplexers couple each driving voltage produced by said plurality of voltage drivers to a respective one of the columns when the control signal is in its second state during every row drive period.

3. The column driver circuit recited by claim 2 wherein said plurality of voltage drivers provide a driving voltage that is of one polarity during one row driving period for a selected row, and provide a driving voltage of an opposite polarity during a next row drive period for the same selected row.

4. The column driver circuit recited by claim 3 wherein said plurality of voltage drivers provide a driving voltage that is of one polarity during one row driving period for a selected row, and provide a driving voltage of an opposite polarity during a next row drive period for the next succeeding row.

5. The column driver circuit recited by claim 4 wherein said plurality of voltage drivers provide driving voltages to the columns in a manner by which, during any given row drive period, two adjacent columns of the liquid crystal display are driven with two driving voltages that are of opposite polarities when said control signal is in its second state.

6. The column driver circuit recited by claim 2 including a storage capacitor having a first terminal coupled to said common node and coupled to the common terminal of each of said plurality of multiplexers.

7. The column driver circuit recited by claim 6 wherein the liquid crystal display includes a number of columns equal to N, wherein each column of the liquid crystal display has a capacitance $C_{col}$ associated therewith, and wherein the value of the capacitance of said storage capacitor is greater than N times $C_{col}$.

8. The column driver circuit recited by claim 6 wherein said plurality of voltage drivers provide a driving voltage that alternates in polarity between a most-positive voltage and a least-positive voltage, and wherein the midpoint between said most-positive voltage and said least-positive voltage corresponds to a median bias voltage, and wherein said storage capacitor includes a second terminal coupled to a source of said median bias voltage.

9. The column driver circuit recited by claim 8 wherein, during a given row drive period, two adjacent columns of the liquid crystal display are driven with two driving voltages that are above and below, respectively, said median bias voltage when said control signal is in its second state.

10. The column driver circuit recited by claim 6 wherein said storage capacitor includes a second terminal coupled to a terminal of a battery.

11. The column driver circuit recited by claim 2 wherein said plurality of voltage drivers provide a driving voltage that alternates in polarity between a most-positive voltage and a least-positive voltage, and wherein the midpoint between said most-positive voltage and said least-positive voltage corresponds to a median bias voltage, and wherein said common node is coupled to a terminal of a battery sourcing the median bias voltage.

12. The column driver circuit recited by claim 2 wherein each of said multiplexers comprises first and second CMOS transmission gates, the first CMOS transmission gate being coupled between said column terminal and said common terminal for selectively coupling a column of the liquid crystal display to said common node, and said second CMOS transmission gate being coupled between said column terminal and one of said voltage drivers for selectively coupling the driving voltage produced by such voltage driver to its associated column.

13. The column driver circuit recited by claim 2 wherein each of said multiplexers comprises first and second n-channel MOS transistors, the drain terminals of said transistors being coupled in common to a column, the gate terminals of the first and second transistors being coupled to the control signal and to a complement of the control signal, respectively, the source terminal of one of the first and second transistors being coupled to said common terminal, and the source terminal of the other transistor being coupled to one of said voltage drivers.

14. The column driver circuit recited by claim 2 wherein each of said multiplexers comprises first and second p-channel MOS transistors, the drain terminals of said transistors being coupled in common to a column, the gate terminals of the first and second transistors being coupled to the control signal and to a complement of the control signal, respectively, the source terminal of one of the first and second transistors being coupled to said common terminal, and the source terminal of the other transistor being coupled to one of said voltage drivers.

15. A power-saving column driver circuit for applying driving voltages to a plurality of columns in a liquid crystal display, the liquid crystal display including an array of pixels arranged in rows and columns, and the liquid crystal display including row driver circuitry for selecting at least one row in the pixel array during a row drive period, the row driver circuitry selecting all rows in the pixel array at least once during a display cycle, said column driver circuit comprising in combination:

a. clocking means for providing a control signal switching between a first state and a second state during at least one row drive period of each display cycle;

b. a plurality of voltage drivers each having an output terminal coupled to a column of the liquid crystal display, each of said plurality of voltage drivers providing a driving voltage to be applied to a given column of the liquid crystal display during a given row drive period for controlling the pixel located at the given column within the selected row, each such voltage driver having a control input for receiving the control signal and selectively disabling the output terminal of said voltage driver when the control signal is in its first state, and enabling the output terminal of said voltage driver when the control signal is in its second state;

c. a plurality of transmission gates, each of such transmission gates having a control terminal coupled to said clocking means for receiving the control signal, each of such transmission gates having a column terminal coupled to one of the columns of the liquid crystal display, each of such transmission gates having a common terminal, each of such transmission gates electrically coupling the column terminal thereof to the common terminal thereof when the control signal is in the first state, and each of such transmission gates decoupling the column terminal thereof from the common terminal thereof when the control signal is in the second state; and d. a common node coupled to the common terminal of each of said plurality of transmission gates;

e. said plurality of transmission gates electrically coupling each of the columns of the liquid crystal display to said common node when the control signal is in its first state, and said plurality of voltage drivers providing a driving voltage to the columns when the control signal is in its second state.

16. The column driver circuit recited by claim 15 wherein said clocking means functions to switch the control signal between a first state and a second state during every row drive period of each display cycle, whereby said plurality of transmission gates electrically couple each of the columns of the liquid crystal display to said common node when the control signal is in its first state during every row drive period, and the output terminals of said plurality of voltage drivers are enabled to apply the driving voltages produced by said plurality of voltage drivers to the columns when the control signal is in its second state during every row drive period.

17. The column driver circuit recited by claim 16 including a storage capacitor having a first terminal coupled to said common node and coupled to the common terminal of each of said plurality of transmission gates.

18. The column driver circuit recited by claim 17 wherein the liquid crystal display includes a number of columns equal to N, wherein each column of the liquid crystal display has a capacitance $C_{col}$ associated therewith, and wherein the value of the capacitance of said storage capacitor is greater than N times $C_{col}$.

19. The column driver circuit recited by claim 17 wherein said plurality of voltage drivers provide a driving voltage that alternates in polarity between a most-positive voltage and a least-positive voltage, and wherein the midpoint between said most-positive voltage and said least-positive voltage corresponds to a median bias voltage, and wherein said storage capacitor includes a second terminal coupled to a source of said median bias voltage.

20. The column driver circuit recited by claim 17 wherein said storage capacitor includes a second terminal coupled to a terminal of a battery.

21. The column driver circuit recited by claim 16 wherein said plurality of voltage drivers provide a driving voltage that alternates in polarity between a most-positive voltage and a least-positive voltage, and wherein the midpoint between said most-positive voltage and said least-positive voltage corresponds to a median bias voltage, and wherein said common node is coupled to a terminal of a battery sourcing the median bias voltage.

22. The column driver circuit recited by claim 16 wherein each of said plurality of transmission gates includes an n channel transistor having its gate terminal coupled to the control signal and having its source and drain terminals coupled to the column terminal and common terminal, respectively.

23. The column driver circuit recited by claim 16 wherein each of said plurality of transmission gates includes a p channel transistor having its gate terminal coupled to the control signal and having its source and drain terminals coupled to the column terminal and common terminal, respectively.

24. The column driver circuit recited by claim 16 wherein each of said plurality of transmission gates is a CMOS transmission gate including an n-channel transistor and a p-channel transistor coupled in parallel, the gate terminals of said n-channel and p-channel transistor being coupled to the control signal and the complement of the control signal, respectively.

25. A power-saving circuit for applying driving voltages to at least first and second columns in a liquid crystal display, the liquid crystal display including an array of pixels arranged in rows and columns, said circuit comprising in combination:

a. a first voltage driver providing a first driving voltage to be applied to the first column of the liquid crystal display, the first driving voltage ranging between a lowermost voltage and an uppermost voltage;

b. a second voltage driver providing a second driving voltage to be applied to the second column of the liquid crystal display, the second driving voltage ranging between the lowermost voltage and the uppermost voltage;

c. a first common node and a second common node, each of said first and second common nodes establishing a voltage generally proximate to the midpoint between the lowermost voltage and the uppermost voltage;

d. a first multiplexer having a control terminal for receiving a control signal having first and second states, said first multiplexer having a column terminal coupled to said first column of the liquid crystal display, said first multiplexer having an input terminal coupled to said first voltage driver for receiving the first driving voltage, and said first multiplexer having a common terminal coupled to one of said first and second common nodes, said first multiplexer electrically coupling the column terminal thereof to the common terminal thereof when the control signal is in the first state for electrically coupling the first column to a voltage generally proximate to the midpoint between the lowermost voltage and the uppermost voltage, and said first multiplexer electrically coupling the column terminal thereof to the input terminal thereof when the control signal is in the second state for electrically coupling the first column to the first driving voltage; and e. a second multiplexer having a control terminal for receiving the control signal, said second multiplexer having a column terminal coupled to said second column of the liquid crystal display, said second multiplexer having an input terminal coupled to said second voltage driver for receiving the second driving voltage, and said second multiplexer having a common terminal coupled to one of said first and second common nodes, said second multiplexer electrically coupling the column terminal thereof to the common terminal thereof when the control signal is in the first state for electrically coupling the second column to a voltage proximate the midpoint between the lowermost voltage and the uppermost voltage, and said second multiplexer electrically coupling the column terminal thereof to the input terminal thereof when the control signal is in the second state for electrically coupling the second column to the second driving voltage.

26. A method of driving first and second columns in a liquid crystal display while conserving power, said method including the steps of:

a. providing a control signal having a first state and a second state;

b. providing a first driving voltage to be applied to the first column of the liquid crystal display, the first driving voltage ranging between a lowermost voltage and an uppermost voltage;

c. providing a second driving voltage to be applied to the second column of the liquid crystal display, the second driving voltage ranging between the lowermost voltage and the uppermost voltage;

d. providing a first common node and a second common node, each of said first and second common nodes establishing a voltage generally proximate to the midpoint between the lowermost voltage and the uppermost voltage e. electrically coupling the first column to one of said first and second common nodes when the control signal is in the first state, and electrically coupling the first column to the first driving voltage when the control signal is in the second state; and f. electrically coupling the second column to one of said first and second common nodes when the control signal is in the first state, and electrically coupling the second column to the second driving voltage when the control signal is in the second state.

27. A method of driving columns in a liquid crystal display while conserving power, said method including the steps of:

a. providing a first common node;

b. temporarily electrically coupling at least first and second columns of the array to the first common node a first time;

c. applying first and second driving voltages to the first and second columns, respectively, of the array, each of the first and second driving voltages ranging between a lowermost voltage and an uppermost voltage, the midpoint of the range between the lowermost voltage and the uppermost voltage corresponding to an average voltage, the first driving voltage being of a first polarity relative to the average voltage, and the second driving voltage being of a second opposing polarity relative to the average voltage;

d. temporarily electrically coupling the first and second columns of the array to the first common node a second time;

e. applying third and fourth driving voltages to the first and second columns, respectively, of the array, the third driving voltage being of the second polarity relative to the average voltage, and the fourth driving voltage being of the first polarity relative to the average voltage.

28. The method of driving columns in a liquid crystal display while conserving power as recited in claim 27 wherein the first driving voltage, second driving voltage, third driving voltage, and fourth driving voltage are each analog voltages for allowing the first and second pixels within the adjacent first and second rows of pixels to display varying shades of gray.

29. A method of driving columns in a liquid crystal display while conserving power, said columns being driven by voltages ranging from a lowermost voltage to an uppermost voltage, said method including the steps of:

a. providing at least one bias voltage source having a voltage generally proximate to the midpoint between the lowermost voltage and the uppermost voltage;

b. temporarily electrically coupling each of the first and second columns to a bias voltage source a first time;

c. applying first and second driving voltages to the first and second columns, respectively;

d. temporarily electrically coupling each of the first and second columns to a bias voltage source a second time;

e. applying third and fourth driving voltages to the first and second columns, respectively; and f. the first driving voltage, second driving voltage, third driving voltage, and fourth driving voltage each being an analog voltage for allowing the liquid crystal display to display varying shades of gray.

* * * * *